US011854558B2

(12) United States Patent
Lu et al.

(10) Patent No.: US 11,854,558 B2
(45) Date of Patent: Dec. 26, 2023

(54) SYSTEM AND METHOD FOR TRAINING A TRANSFORMER-IN-TRANSFORMER-BASED NEURAL NETWORK MODEL FOR AUDIO DATA

(71) Applicant: Lemon Inc., Grand Cayman (KY)

(72) Inventors: Wei Tsung Lu, Los Angeles, CA (US); Ju-Chiang Wang, Los Angeles, CA (US); Minz Won, Los Angeles, CA (US); Keunwoo Choi, Los Angeles, CA (US); Xuchen Song, Los Angeles, CA (US)

(73) Assignee: Lemon Inc., Grand Cayman (KY)

( * ) Notice: Subject to any disclaimer, the term of this patent is extended or adjusted under 35 U.S.C. 154(b) by 42 days.

(21) Appl. No.: 17/502,863

(22) Filed: Oct. 15, 2021

(65) Prior Publication Data

US 2023/0124006 A1 Apr. 20, 2023

(51) Int. Cl.
*G10L 19/02* (2013.01)
*G10L 25/30* (2013.01)

(52) U.S. Cl.
CPC ..... *G10L 19/02* (2013.01); *G10L 25/30* (2013.01)

(58) Field of Classification Search
CPC ..... G10L 19/02; G10L 25/30
USPC ..... 704/500
See application file for complete search history.

(56) References Cited

U.S. PATENT DOCUMENTS 8,046,214 B2 * 10/2011 Mehrotra ..... G10L 19/008 455/72
2008/0312758 A1 * 12/2008 Koishida ..... G10L 19/02 700/94

FOREIGN PATENT DOCUMENTS

JP 2009524108 A * 6/2009 ..... G10L 21/04
WO 2021101665 A1 5/2021

OTHER PUBLICATIONS

An apparatus comprising: at least one processor and a non-transitory computer-readable medium storing therein computer program code including instructions for one or more programs that, when executed by the processor, cause the processor to: Dec. 2, 2019 (Year: 2019).*

(Continued)

*Primary Examiner* — Bharatkumar S Shah
(74) *Attorney, Agent, or Firm* — Faegre Drinker Biddle & Reath LLP

(57) ABSTRACT

Devices, systems and methods related to causing an apparatus to generate music information of audio data using a transformer-based neural network model with a multilevel transformer for audio analysis, using a spectral and a temporal transformer, are disclosed herein. The processor generates a time-frequency representation of obtained audio data to be applied as input for a transformer-based neural network model; determines spectral embeddings and first temporal embeddings of the audio data based on the time-frequency representation of the audio data; determines each vector of a second frequency class token (FCT) by passing each vector of the first FCT in the spectral embeddings through the spectral transformer; determines second temporal embeddings by adding a linear projection of the second FCT to the first temporal embeddings; determines third temporal embeddings by passing the second temporal embeddings through the temporal transformer; and generates music information based on the third temporal embeddings.

16 Claims, 8 Drawing Sheets

(56) References Cited

OTHER PUBLICATIONS

An apparatus comprising: at least one processor and a non-transitory computer-readable medium storing therein computer program code including instructions for one or more programs that, when executed by the processor, cause the processor to: Dec. 2, 2019 (Year: 2019) (Year: 2019).*

K. G. Gopalan, D. S. Benincasa and S. J. Wenndt, "Data embedding in audio signals," 2001 IEEE Aerospace Conference Proceedings (Cat. No. 01TH8542), Big Sky, MT, USA, 2001, pp. 2713-2720 vol. 6, doi: 10.1109/AERO.2001.931292. (Year: 2001).*

International Search Report dated Jun. 11, 2023 in International Application No. PCT/SG2022/050704.

Han K. et al., "Transformer in Transformer," 35th Conference on Neural Information Processing Systems, Jul. 5, 2021, pp. 1-12 [Retrieved on May 23, 2023].

Zadeh A. et al., "WildMix Dataset and Spectro-Temporal Transformer Model for Monoaural Audio Source Separation," Nov. 21, 2019, pp. 1-11 [Retrieved on May 23, 2023].

* cited by examiner

SYSTEM AND METHOD FOR TRAINING A TRANSFORMER-IN-TRANSFORMER-BASED NEURAL NETWORK MODEL FOR AUDIO DATA

TECHNICAL FIELD

This disclosure relates to machine learning, particularly to machine learning methods and systems based on transformer architecture.

BACKGROUND

In the field of machine learning, transformers as disclosed in A. Vaswani, et al., "Attention is all you need," 31*st Conference on Neural Information Processing Systems,* 2017 (dated Dec. 6, 2017) are used in fields such as natural language processing and computer vision. In a more recent development, a transformer-in-transformer (TNT) architecture has been proposed by K. Han, et al., "Transformer in transformer," arXiv preprint arXiv:2103.00112, 2021 (dated Jul. 5, 2021), in which local and global information are modeled such that sentence position encoding can maintain the global spatial information, while word position encoding is used for preserving the local relative position. However, such multilevel transformer architecture in the field of music information retrieval such as audio data recognition has yet to be proposed or developed. As such, further development is required in this field with regards to transformers for audio data recognition.

SUMMARY

Devices, systems and methods related to causing an apparatus to generate music information of the audio data using a transformer-based neural network model with a multilevel transformer for audio analysis, using a spectral transformer and a temporal transformer, are disclosed herein. For example, the apparatus, or methods implemented using the apparatus, may include at least one processor and at least one memory including computer program code for one or more programs, the memory and the computer program code being configured to, with the processor, cause the apparatus to train a transformer-based neural network model. The apparatus may be configured to train the multilevel transformer.

In some examples, the apparatus includes at least one processor and a non-transitory computer-readable medium storing therein computer program code including instructions for one or more programs that, when executed by the processor, cause the processor to perform the following steps: obtain audio data; generate a time-frequency representation of the audio data to be applied as input for a transformer-based neural network model, the transformer-based neural network model comprising a transformer-in-transformer module which includes a spectral transformer and a temporal transformer; determine spectral embeddings and first temporal embeddings of the audio data based on the time-frequency representation of the audio data, the spectral embeddings including a first frequency class token (FCT); determine each vector of a second FCT by passing each vector of the first FCT in the spectral embeddings through the spectral transformer; determine second temporal embeddings by adding a linear projection of the second FCT to the first temporal embeddings; determine third temporal embeddings bypassing the second temporal embeddings through the temporal transformer; and generate music information of the audio data based on the third temporal embeddings.

In some examples, the spectral embeddings are determined by generating the first FCT to include at least one spectral feature from a frequency bin and frequency positional encodings (FPE) to include at least one frequency position of the first FCT. In some examples, each of the spectral transformer and the temporal transformer comprises a plurality of encoder layers, each encoder layer comprising a multi-head self-attention module, a feed-forward network module, and a layer normalization module. In some examples, each of the spectral transformer and the temporal transformer comprises a plurality of decoder layers configured to receive an output from one of the encoder layers, each decoder layer comprising a multi-head self-attention module, a feed-forward network module, a layer normalization module, and an encoder-decoder attention module.

In some examples, the spectral embeddings are matrices with matrix dimensions that are determined based on a number of frequency bins and a number of channels employed by the transformer-in-transformer module, and a number of the spectral embeddings is determined by a number of time-steps employed by the transformer-in-transformer module. In some examples, the temporal embeddings are vectors having a vector length determined by a number of features employed by the transformer-in-transformer module, and a number of the temporal embeddings is determined by a number of time-steps employed by the transformer-in-transformer module.

In some examples, the transformer-based neural network model comprises a plurality of transformer-in-transformer modules in a stacked configuration such that the temporal embedding is updated through each of the plurality of transformer-in-transformer modules. In some examples, the spectral transformer and the temporal transformer are arranged hierarchically such that the spectral transformer is configured to generate local music information of the audio data and the temporal transformer is configured to generate global music information of the audio data.

According to another implementation, a method implemented by at least one processor is disclosed, where the method includes the steps of: obtaining audio data; generating a time-frequency representation of the audio data to be applied as input for a transformer-based neural network model, the transformer-based neural network model comprising a transformer-in-transformer module which includes a spectral transformer and a temporal transformer; determining spectral embeddings and first temporal embeddings of the audio data based on the time-frequency representation of the audio data, the spectral embeddings including a first frequency class token (FCT); determining each vector of a second FCT by passing each vector of the first FCT in the spectral embeddings through the spectral transformer; determining second temporal embeddings by adding a linear projection of the second FCT to the first temporal embeddings; determining third temporal embeddings by passing the second temporal embeddings through the temporal transformer; and generating music information of the audio data based on the third temporal embeddings.

In some examples, the method also includes the step of determining the spectral embeddings by generating the first FCT to include at least one spectral feature from a frequency bin and generating frequency positional encodings (FPE) to include at least one frequency position of the first FCT. In some examples, each of the spectral transformer and the temporal transformer comprises a plurality of encoder layers, each encoder layer comprising a multi-head self-attention module, a feed-forward network module, and a layer normalization module. In some examples, each of the spectral transformer and the temporal transformer comprises a plurality of decoder layers configured to receive an output from one of the encoder layers, each decoder layer comprising a multi-head self-attention module, a feed-forward network module, a layer normalization module, and an encoder-decoder attention module.

In some examples, the spectral embeddings are matrices with matrix dimensions that are determined based on a number of frequency bins and a number of channels employed by the transformer-in-transformer module, and a number of the spectral embeddings is determined by a number of time-steps employed by the transformer-in-transformer module. In some examples, the temporal embeddings are vectors having a vector length determined by a number of features employed by the transformer-in-transformer module, and a number of the temporal embeddings is determined by a number of time-steps employed by the transformer-in-transformer module.

In some examples, the transformer-based neural network model comprises a plurality of transformer-in-transformer modules in a stacked configuration such that the temporal embedding is updated through each of the plurality of transformer-in-transformer modules. In some examples, the spectral transformer and the temporal transformer are arranged hierarchically such that the spectral transformer is configured to generate local music information of the audio data and the temporal transformer is configured to generate global music information of the audio data.

BRIEF DESCRIPTION OF THE DRAWINGS

The implementations will be more readily understood in view of the following description when accompanied by the below figures, wherein like reference numerals represent like elements, and wherein.

DETAILED DESCRIPTION

Briefly, systems and methods include a transformer-in-transformer (TNT) architecture which implements a spectral transformer which extracts frequency-related features into frequency class token (FCT) for each frame of audio data such that the FCT is linearly projected and added to temporal embeddings which aggregate useful information from the FCT. The TNT architecture also implements a temporal transformer which processes the temporal embeddings to exchange information across the time (temporal) axis. This architecture of implementing a spectral transformer and a temporal transformer is referred to herein as spectral-temporal TNT in which a plurality of such TNT blocks may be stacked to build the spectral-temporal TNT model architecture to learn the representation for audio data such as music signals, to perform tasks such as music information retrieval (MIR) research and analysis including, but not limited to, music tagging, vocal melody extraction, chord recognition, etc.

Figure 1:
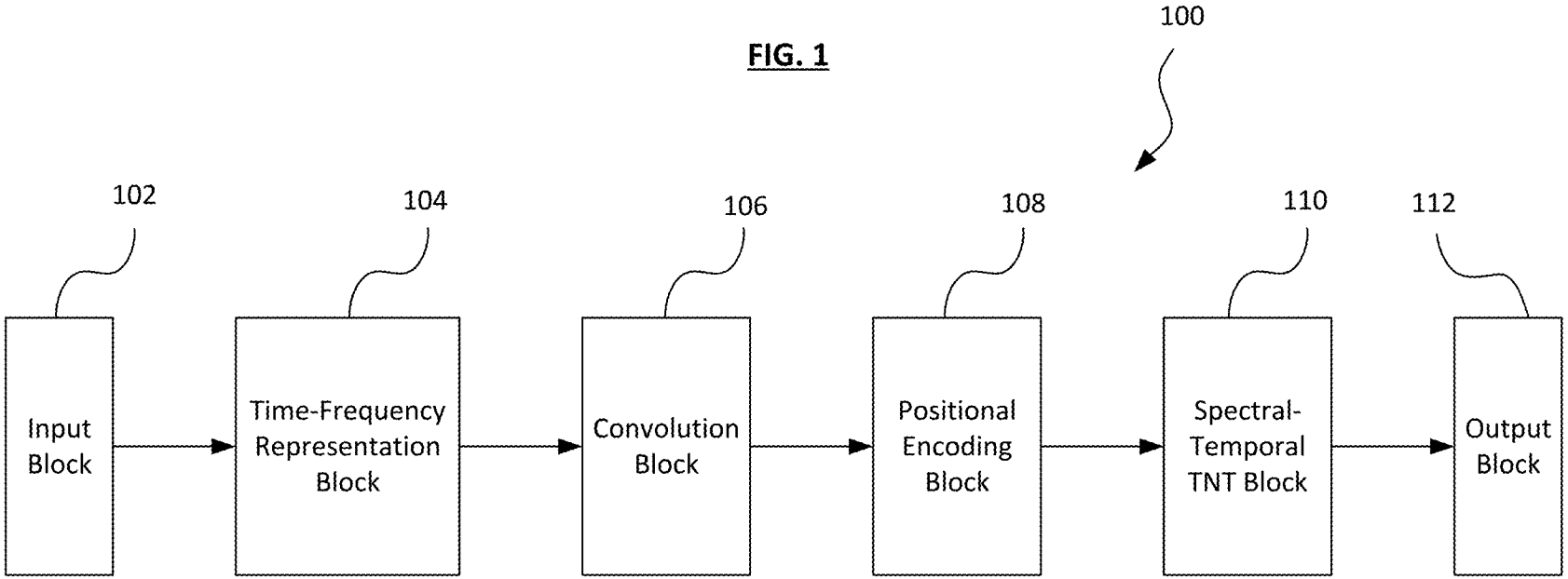
FIG. 1 shows a block diagram of an exemplary transformer-based neural network model according to examples disclosed herein.

In MIR analysis, the time axis is represented as an axis of sequence, and the frequency axis is represented as an axis of feature. Referring to FIG. 1, an exemplary transformer-based neural network model 100 is shown according to examples disclosed herein. Audio data such as music clips, audio signals, and/or voice recordings, for example, is inputted via an input block 102. A time-frequency representation block 104 is any suitable module such as a microprocessor, processor, state machine, etc. which is capable of generating a time-frequency representation of the audio data (also referred to as an input time-frequency representation), which is a view of the audio signal represented over both time and frequency, as known in the art. A convolution block 106 is any suitable module which is capable of processing the input time-frequency representation with a stack of convolutional layers for local feature aggregation, as known in the art.

A positional encoding block 108 is any suitable module which is capable of adding positional information to the input time-frequency representation after it is processed through the convolution block 106. The specifics of how the positional information is added are explained with regard to FIGS. 2 and 3. The resulting data, i.e. the input time-frequency representation with the positional information added, is fed into a spectral-temporal TNT block 110 or a stack of such TNT blocks. The specifics of how each of the spectral-temporal TNT blocks processes the data are explained with regard to FIGS. 4, 5, and 8. An output block 112 is any suitable module which projects the final embeddings into a desired dimension for different tasks.

Figure 2:
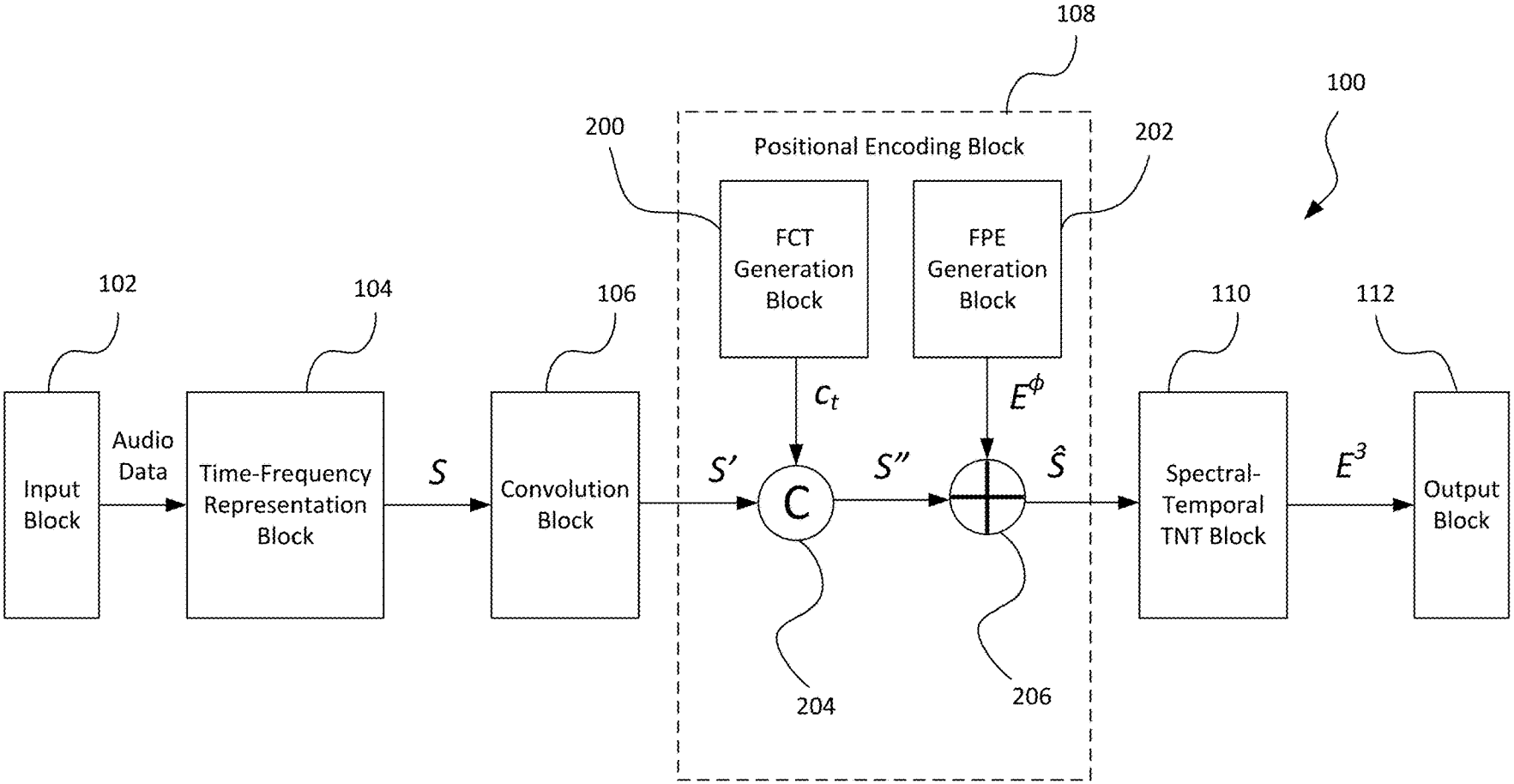
FIG. 2 shows a block diagram of an exemplary transformer-based neural network model according to examples disclosed herein.

FIG. 2 illustrates the data flow between the blocks introduced in FIG. 1, and shows more specifically the functionality of the positional encoding block 108 according to examples of the neural network model 100 disclosed herein. Initially, raw audio data ("Audio Data") is inputted into the time-frequency representation block 104 to generate the input time-frequency representation (S). The representation S is a matrix denoted as $S \in \mathbb{R}^{T \times F \times K}$, where S is a three-dimensional matrix with dimensions T, F, and K, where T is the number of time-steps, F is the number of frequency bins, and K is the number of channels. The representation S is passed into a stack of convolutional layers in the convolution blocks 106, such that the representation after the convolutional block 106 may be denoted as $S' = [S'_1, S'_2, \ldots, S'_{T'}] \in \mathbb{R}^{T' \times F' \times K'}$ where T', F', and K' are the numbers of frequency bins, time-steps, and channels, respectively.

Figure 3:
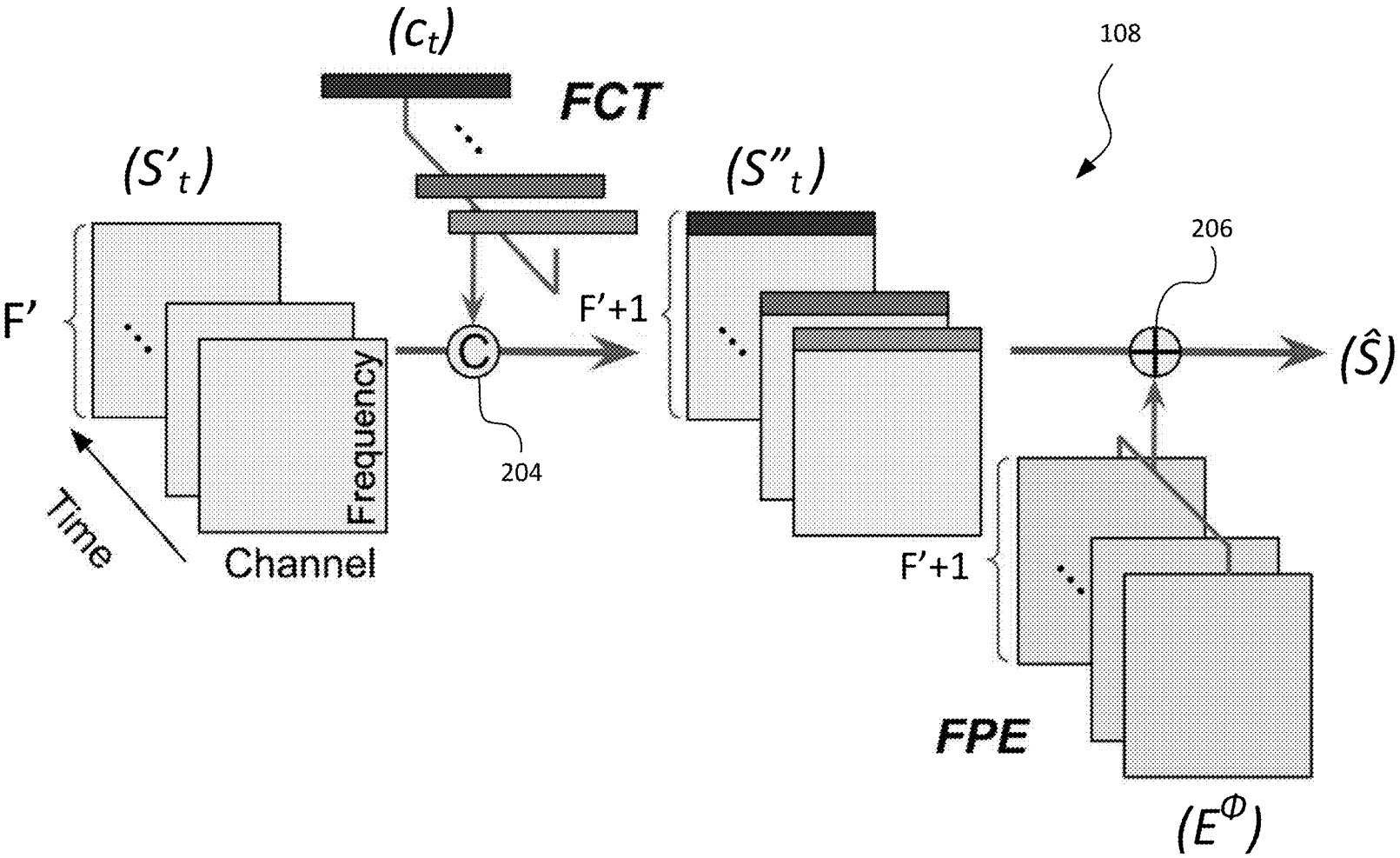
FIG. 3 shows a block diagram of an exemplary positional encoding block according to examples disclosed herein.

With regard to FIG. 2 and also to FIG. 3, which illustrates not only the data flow in the positional encoding block 108 but also the dimensions of each vector or matrix that is generated therein, a frequency class token (FCT, also represented as $c_t$) is a learnable embedding vector initialized with all zeroes to serve as a placeholder and defined as $c_t=0^{1\times K'}$, i.e., a zero vector of dimension K'. The FCT vectors are generated by an FCT generation block 200, based on the determined value of K', for each time-step. Input data at each time-step t is denoted as $S'_t \in \mathbb{R}^{F'\times K'}$, and each of the FCT vectors is concatenated with the input data at a matching time-step using a concatenator 204, that is, $S''_t=\text{Concat}[c_t, S'_t]$ where S" denotes an FCT-concatenated representation of S'. The concatenation implements each of the $c_t$ vectors to an end of the corresponding $S'_t$ matrix, which changes the dimensions of the matrix such that the resulting $S''_t$ matrix has the dimensions F'+1 by K'.

A frequency positional embedding (FPE, also represented as $E^{\phi}$) is a learnable matrix which is used to apply frequency positional encoding to the representation and is generated by an FPE generation block 202. The FPE matrix is denoted by $E^{\phi}\in \mathbb{R}^{(F'+1)\times K'}$. An element-wise adder 206 implements element-wise addition with $S''_t$ and $E^{\phi}$, the result of which is denoted as $\hat{S}_t=S''_t \oplus E^{\phi}$ (where $\oplus$ denotes the element-wise addition). The combined three-dimensional matrix for all time-steps t, i.e. $\hat{S}$ having the dimensions T', F'+1, and K', is the output of the positional encoding block 108. In the resulting representation matrix $\hat{S}$, the FCT vectors therein are collectively denoted by $\hat{C}=[\hat{c}_1, \hat{c}_2, \ldots, \hat{c}_{T'}]$ which allows the representation matrix $\hat{S}$ to carry information such as pitch and timbre of the audio data to the following attention layers. For example, a pitch in the signal can lead to high energy at a specific frequency bin, and the positional encoding makes each of the FCT vector aware of the frequency position.

Figure 4:
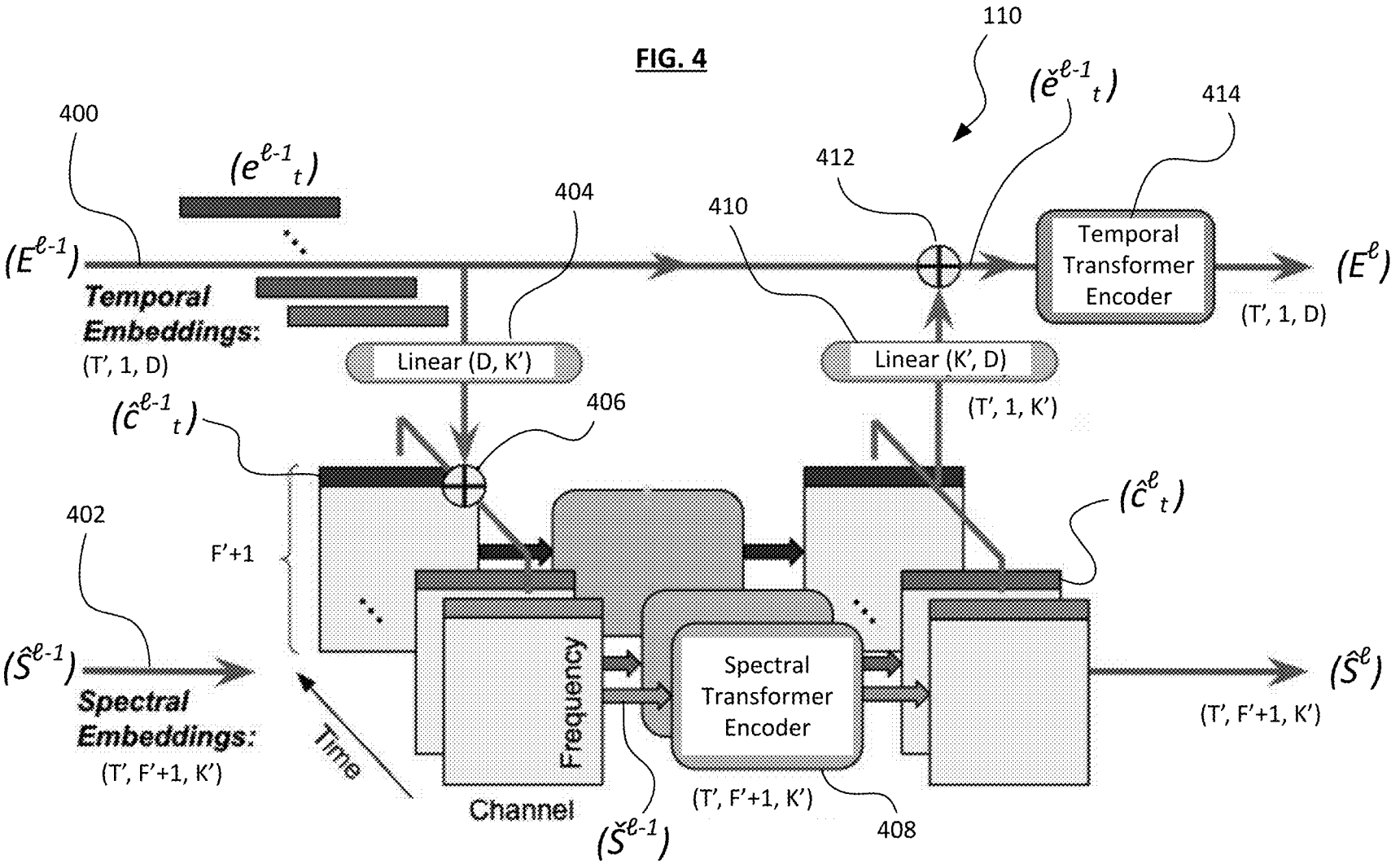
FIG. 4 shows a block diagram of an exemplary spectral-temporal transformer-in-transformer block according to examples disclosed herein.

FIG. 4 illustrates the encoding portion of an exemplary spectral-temporal TNT block 110 according to examples disclosed herein. The TNT block 110 includes two data flows: temporal embeddings 400 and spectral embeddings 402. The two data flows are respectively processed with two transformer encoders, or more specifically the temporal embeddings 400 are processed with a temporal transformer encoder 414 and the spectral embeddings are processed with a spectral transformer encoder 408. Acting as the "bridges" between the two data flows are linear projection blocks (or layers) 404 and 410, and the temporal embeddings 400 also includes an adder 412. The spectral embeddings 402 also includes another adder 406. In the following descriptions of the TNT block 110, the notation f is introduced to specify the layer index for both embeddings.

With regard to the data flow of the temporal embeddings 400, $E^l$ is used to denote the temporal embedding matrix which is a combination of individual temporal embedding vectors at layer l, such that $E^l=[e^l_1, e^l_2, \ldots, e^l_{T'}]$, where $e^l_t\in \mathbb{R}^{1\times D}$, that is, each $e^l_t$ is a temporal embedding vector at time t of dimension D, and D is the number of features $E^l$ is a learnable temporal embedding matrix which is randomly initialized as $E^0\in \mathbb{R}^{T'\times D}$, prior to entering the first spectral-temporal TNT block. As the temporal embedding matrix passes through each subsequent layer, the learnable matrix $E^l$ is gradually improved.

In the following examples, the FCT vectors are located in the first frequency bin of the spectral embedding matrix, i.e. $\hat{S}^l$. The initial $\hat{S}^l$ matrix (or $\hat{S}^0$) which enters the first spectral-temporal TNT block, is the output obtained from the positional encoding block 108, previously denoted as S in FIG. 3. As mentioned above, the spectral embeddings include FCT vectors, which assist in aggregating useful local spectral information. As a general notation, $\hat{S}^l$ can be written as: $\hat{S}^l=\{[\hat{c}^l_1, \hat{S}^l_1], [\hat{c}^l_2, \hat{S}_2], \ldots [\hat{c}^l_{T'}, \hat{S}^l_{T'}]\}$, where l=0, 1, . . . , L; $\hat{c}^l_t$ is the FCT vectors of the t-th layer at time-step t; and $\hat{S}^l_t$ is the spectral data at time-step t. The spectral embedding can then interact with the temporal embedding through the FCT vectors, so the local spectral features can be processed in a temporal, global manner.

For example, each of the temporal embedding vectors, that is, $e^{l-1}_1, e^{l-1}_2, \ldots, e^{l-1}_{T'}$, of the learnable matrix $E^{l-1}$ is passed through the linear projection layer 404, which transforms the vectors from having the dimension of D to having the dimension of K'. This enables the projected vectors of dimension K' to be added, using the adder 406, with the first frequency bin of the spectral embedding matrix $\hat{S}^{l-1}$, which is where the FCT vectors are located. The result of adding the projected vectors to the spectral embedding matrix is denoted as $\check{S}^{l-1}$. The resulting matrix $\check{S}^{l-1}$ is inputted into the spectral transformer encoder 408 which outputs the matrix $\hat{S}^l$, which can be used as the input spectral embedding for the next layer.

The output matrix $\hat{S}^l$ is then passed through the linear projection layer 410, which transforms each of the FCT vectors of the output matrix $\hat{S}^l$, that is, the vectors located in the first frequency bin of the output spectral embedding matrix $\hat{S}^l$, changing the dimension from K' to D. The linearly projected FCT vectors are then added with the temporal embedding vectors $e^{l-1}_1, e^{l-1}_2, \ldots, e^{l-1}_{T'}$ using the adder 412. The added vectors $(e^l_1, e^l_2, \ldots, e^l_{T'})$ are inputted into the temporal transformer encoder 414 to obtain the matrix $E^l$, which can be used the input temporal embedding for the next layer.

Figure 5:
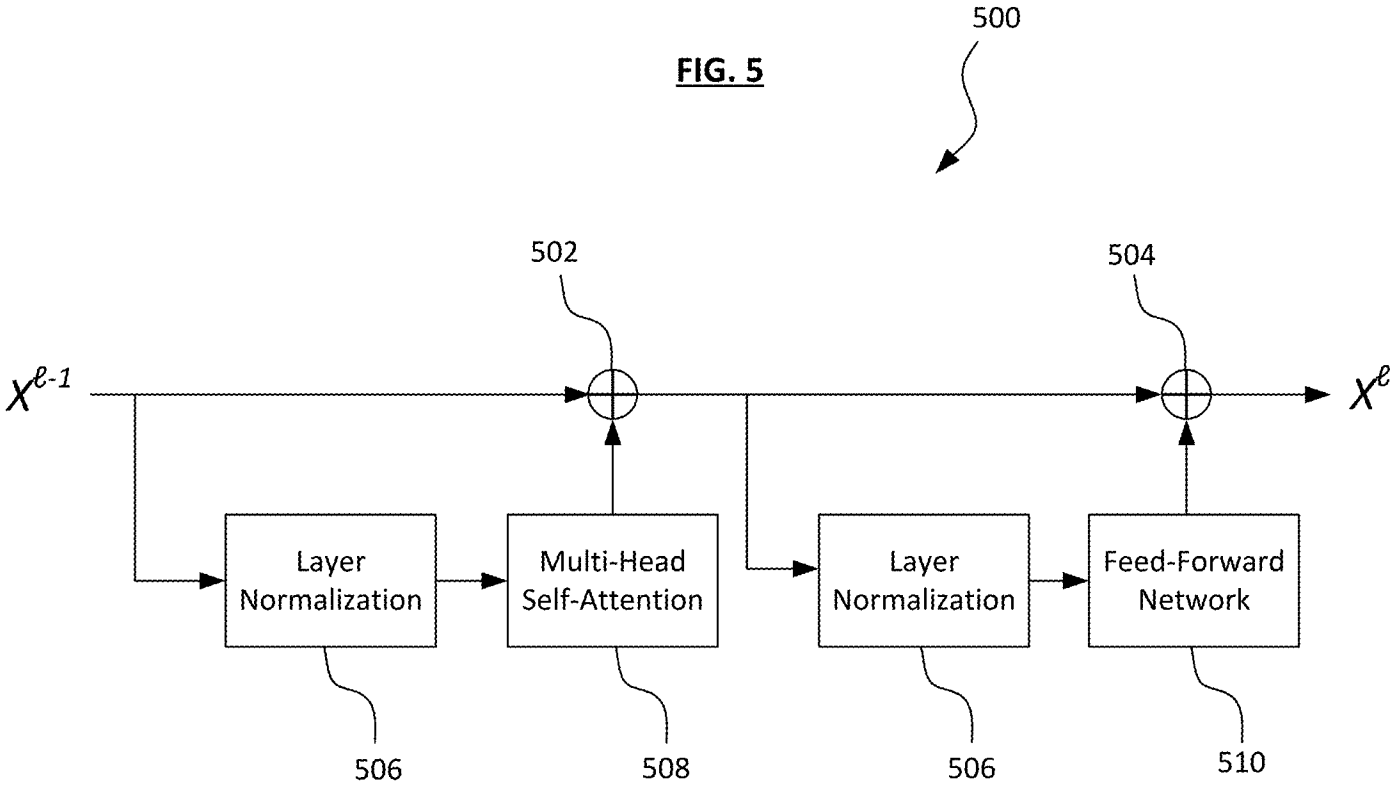
FIG. 5 shows a dataflow diagram of each layer of an exemplary spectral-temporal transformer-in-transformer block according to examples disclosed herein.

FIG. 5 illustrates the components and the data flow within each of the transformer encoders 500 from one transformer layer (l–1) to the next layer (l). Hereinafter, X is used to represent either of the temporal or spectral embedding. The transformer encoder 500 includes layer normalization (LN) component or module 506, multi-head self-attention (MHSA) component or module 508, and feed-forward network (FFN) component or module 510, as well as two adders 502 and 504. Self-attention takes three inputs: Q (query), K (key), and V (value). These inputs are defined as matrices of the following properties: $Q\in \mathbb{R}^{T\times dq}$, $K\in \mathbb{R}^{T\times dk}$, and $V\in \mathbb{R}^{T\times dv}$, where T is the number of time-steps, $d_q$ is the number of features for Q, $d_k$ is the number of features for K, and $d_v$ is the number of features for V. The output is the weighted sum over the values based on the similarity between queries and keys at the corresponding time-step, as defined by the following equation:

$$\text{Attention}(Q, K, V) := SoftMax\left(\frac{QK^T}{\sqrt{d_k}}\right) \quad \text{(Equation 1)}$$

The MHSA module 508 is an extension of the self-attention such that the three inputs Q, K, and V are split along their feature dimension into h numbers of heads, and then multiple self-attentions are performed in parallel, each self-attention being performed on one of the heads. The output of the heads are then concatenated and linearly projected into the final output. The FFN module 510 has two linear layers with a Gaussian Error Linear Unit (GELU) activation function there between. In some examples, the pre-norm residual units are also implemented to stabilize the training of the model.

Generally, the transformer encoder 500 operates such that $X^l=\text{Enc}(X^{l-1})$, where the Enc(•) operation is performed as follows. In a first portion of the encoder 500, the temporal embedding matrix or vector $X^{l-1}$ is passed through the layer normalization module 506 and subsequently through the multi-head self-attention module 508. The resulting matrix or vector from the multi-head self-attention module 508 is added to the original matrix or vector $X^{l-1}$, where the result thereof can be denoted as $X'^{l-1}$. In the next portion of the encoder 500, the resulting matrix or vector $X'^{l-1}$ is passed through the layer normalization module 506 and subsequently through the feed-forward network module 510, after which the resulting matrix or vector from the feed-forward network module 510 is added to the original matrix or vector $X'^{l-1}$, and the final result is outputted in the form of vector or matrix $X^l$ to be inputted into the next transformer layer.

In some examples, multiple spectral-temporal TNT blocks 110 are stacked to form a spectral-temporal TNT module. For example, there may be three TNT blocks 110 in one such TNT module. The module may start with inputting the initial spectral embedding matrix $\hat{S}^0$ and the initial temporal embedding matrix $E^0$ for the first TNT block. For each TNT block, as shown in FIG. 4, there are four steps.

In the first step, each of the FCT vectors $\hat{c}^{l-1}_t$ in $\hat{S}^{l-1}$ is updated by adding the linear projection of the associated temporal embedding vector $e^{l-1}_t$ using the linear projection layer 404. This operation is represented by $\check{c}^{l-1}_t=\hat{c}^{l-1}_t \oplus \text{Linear}(e^{l-1}_t)$, where $\check{c}^{l-1}_t$ is the updated FCT vector from the previous FCT vector $\hat{c}^{l-1}_t$, and the Linear(•) operation represents a shared linear layer, i.e. the linear projection layer 404.

In the second step, the spectral embedding matrix $\check{S}^{l-1}$, which includes the updated FCT vectors $\check{c}^{l-1}_t$ ranging from t=1 to t=T' at the first frequency bin or the first row, is passed through the spectral transformer encoder 408, defined as $\hat{S}^l=\text{SpecEnc}(\check{S}^{l-1})$.

In the third step, each of the FCT vectors $\hat{c}^l_t$ in $\hat{S}^l$ is linearly projected and added back to the corresponding temporary embedding vector $e^{l-1}_t$ such that $\check{e}^{l-1}_t=e^{l-1}_t \oplus \text{Linear}(\hat{c}^l_t)$, where $\check{e}^l_t$ denotes the updated temporal embedding vectors located in an updated temporal embedding matrix $\check{E}^{l-1}$.

Lastly, in the fourth step, the updated temporal embedding matrix $\check{E}^{l-1}$, instead of the sum of the temporal embedding matrix $E^{l-1}$ and the spectral embedding matrix $\hat{S}^{l-1}$, is subsequently updated using the temporal transformer encoder 414, represented by the TempEnc(•) function, such that $E^l=\text{TempEnc}(\check{E}^{l-1})$. This operation assists in building up the relationship along the time axis and is therefore beneficial in improving performance of the transformer-based neural network model by reducing the number of parameters. Moreover, the temporal transformer does not require access to the information of every frequency bin, but rather only the important frequency bins that are attended by the FCT vectors, within each spectral embedding matrix.

The output block 112 receives the final output of the TNT blocks 110, denoted as $E^3$, which is the temporal embedding matrix from the third TNT block, which is the final TNT block in the TNT module. Although the number three (3) is depicted, it is to be understood that there may be any suitable number of TNT blocks, such as more or less than three TNT blocks, depending on the amount of data that is to be learned.

Different outputs may be required from the output block 112 depending on the tasks that are to be performed using such output. For example, in frame-wise prediction tasks such as vocal melody extraction and chord recognition, each temporal embedding vector $e^3_t$ is fed into a shared fully-connected layer with sigmoid or SoftMax function for the final output. For example, in song-prediction tasks such as music tagging, the output block 112 initiates a temporal class token vector $\varepsilon^l$, where l=0, that is concatenated at the front end of $E^l$ to form another matrix $\hat{E}^l$ such that $\hat{E}^l=[\varepsilon^l, e^l_1, e^l_2, \ldots, e^l_{T'}]$. Note that the temporal class token vector $\varepsilon^l$ does not have an associated FCT vector in the spectral embedding matrix because the temporal class token vector $\varepsilon^l$ operates to aggregate the temporal embedding vectors along the time axis. Lastly, the $\epsilon^3$ vector, representing the temporal class token vector after the third TNT block, is fed to a fully-connected layer, followed by a sigmoid layer, to obtain the probability output.

Figure 6:
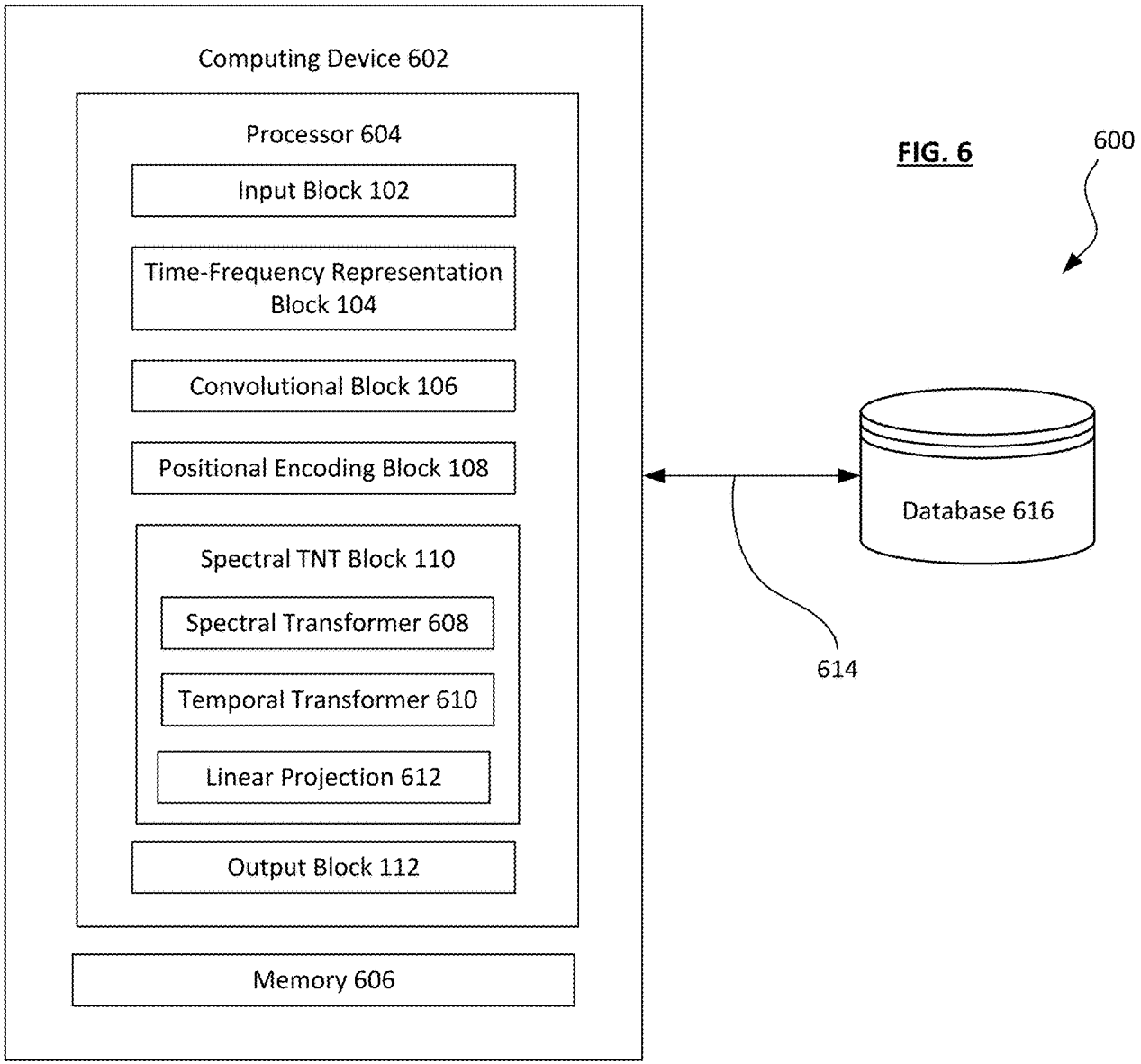
FIG. 6 shows a block diagram of an exemplary computing device and a database for implementing the transformer-based neural network model according to examples disclosed herein.

FIG. 6 illustrates an exemplary computing system 600 which implements the spectral-temporal TNT blocks as disclosed herein. The system 600 includes a computing device 602, for example a computer or a smart device capable of performing computations necessary to training a TNT-based neural network model for audio data. The computing device 602 has a processor 604 and a memory unit 606, and may also be operably coupled with a database 616 such as a remote data server via a connection 614 including wired or wireless data communication means such as a cloud network for cloud-computing capability.

In the processor 604, there are modules capable of performing each of the blocks 102, 104, 106, 108, 110, and 112 as previously disclosed. The modules may be implemented in a computer program, software, or firmware incorporated in a non-transitory computer-readable storage medium, such as the memory unit 606, for execution by the processor 604. Furthermore, in each spectral TNT block 110, there are a spectral transformer block 608, temporal transformer block 610, and linear projection block 612, such that a plurality of spectral TNT blocks 110 may include a plurality of individually operable spectral transformers 608, temporal transformers 610, and linear projection blocks 612, to achieve the multilevel transformer architecture disclosed herein.

Figure 7:
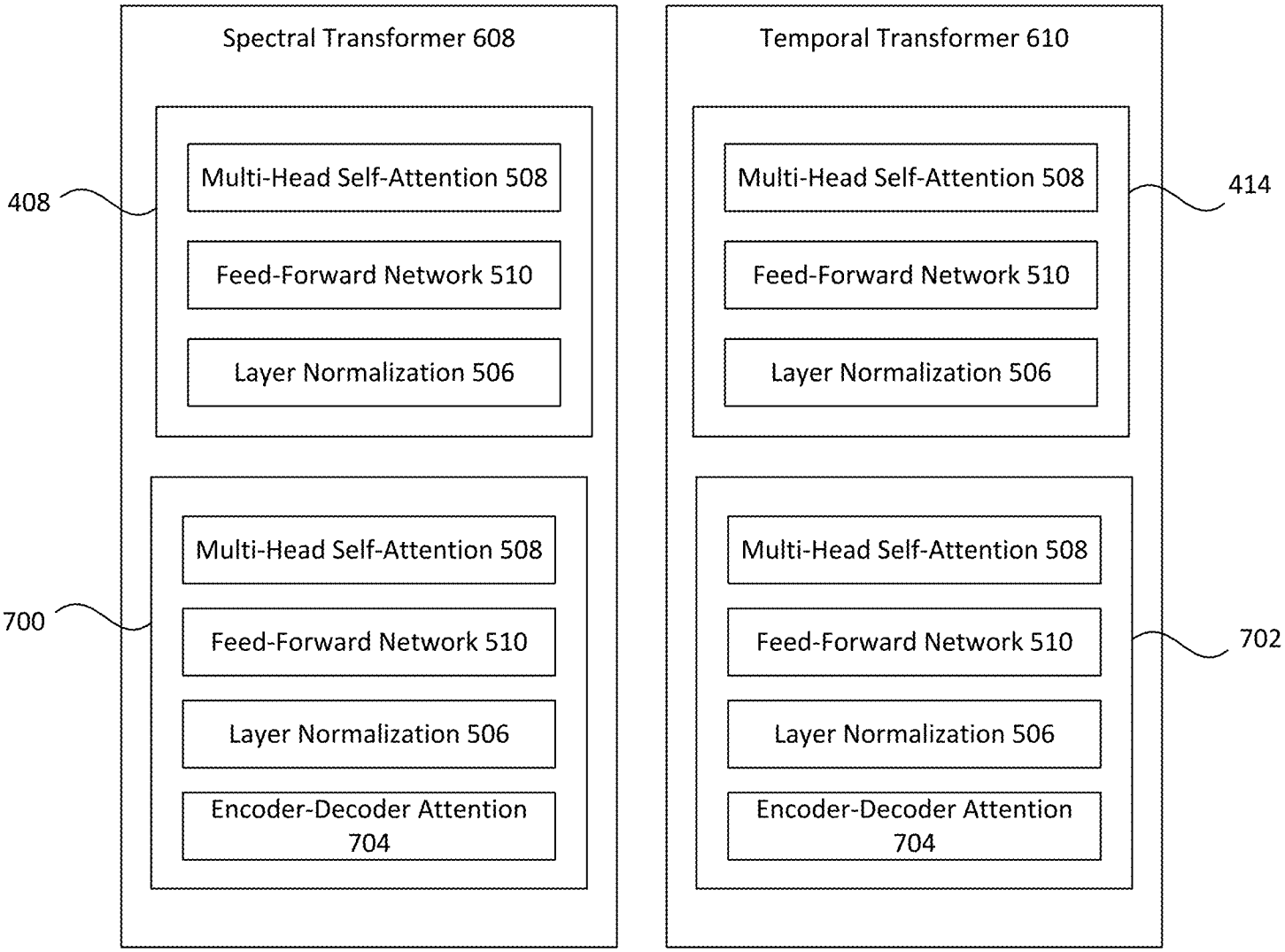
FIG. 7 shows a block diagram of an exemplary spectral transformer block and a temporal transformer block according to examples disclosed herein.

FIG. 7 illustrates an exemplary spectral transformer block 608 and an exemplary temporal transformer block 610 as disclosed herein. As previously explained, each transformer has a plurality of encoders as well as a plurality of decoders. In the figure, only one of each is shown for simplicity, but it is understood that such encoders and decoders may be distributed in any suitable configuration, for example serially or in parallel, within the transformer, as known in the art. For example, each encoder 408 of the spectral transformer 608 includes the multi-head self-attention block 508, the feed-forward network block 510, and the layer normalization block 506 necessary to implement the data flow illustrated in FIG. 5, and similar blocks are also implemented in each encoder 414 of the temporal transformer 610 to implement the same.

The decoder 700 of the spectral transformer block 608 and the decoder 702 of the temporal transformer block 610 also have similar component blocks, mainly the multi-head self-attention block 508, the feed-forward network block 510, the layer normalization block 506, and an encoder-decoder attention block 704 which helps the decoder 700 or 702 focus on the appropriate matrices that are outputted from each encoder.

Figure 8:
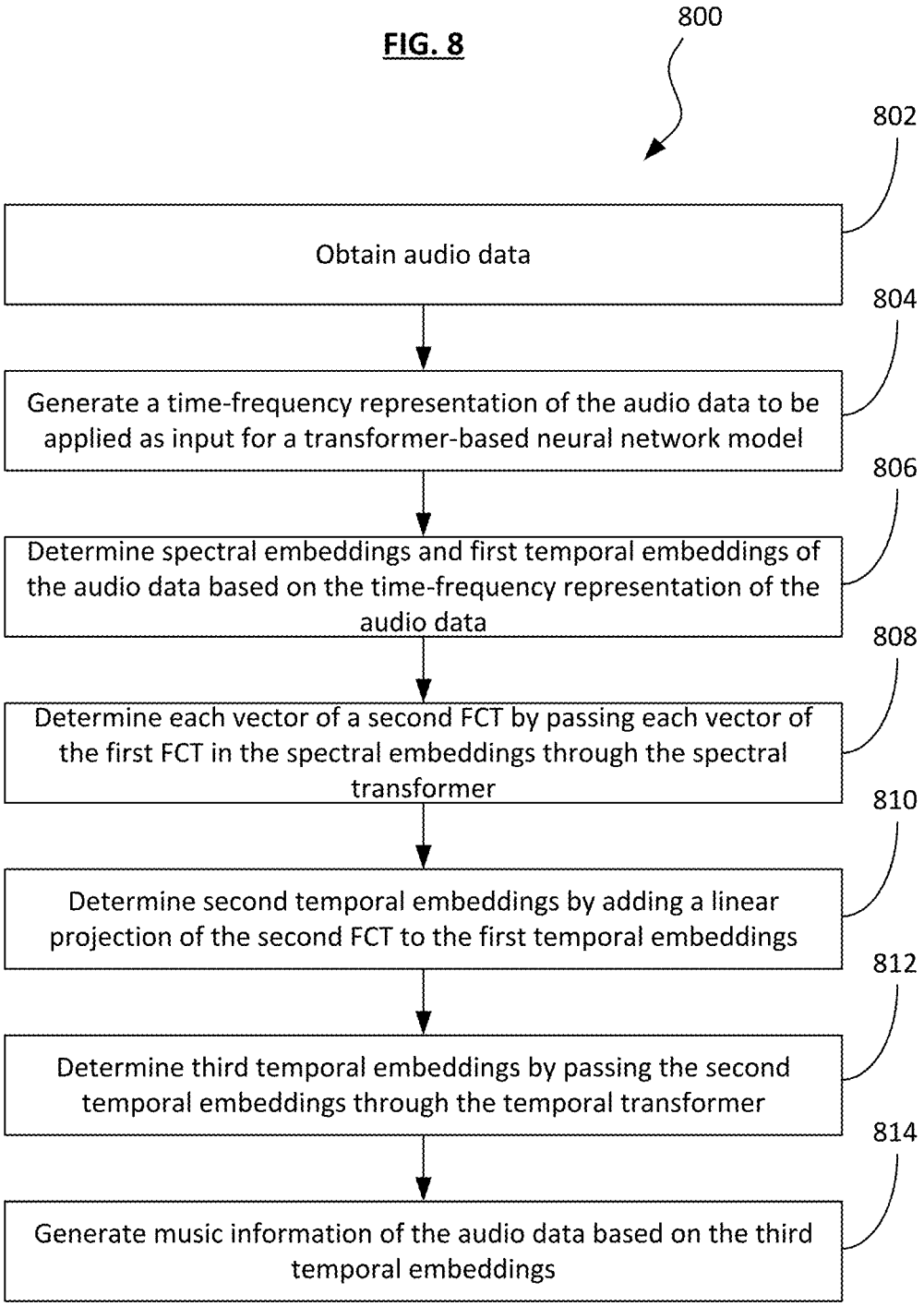
FIG. 8 shows a flowchart of an exemplary method of implementing the transformer-based neural network model according to examples disclosed herein.

FIG. 8 illustrates an exemplary method or process 800 followed by the processor in implementing the spectral-temporal TNT blocks as disclosed herein to use a TNT-based neural network model for audio data analysis and processing to obtain information (for example, music information or sound identification information) regarding the audio data, as explained herein. In step 802, the processor obtains an audio data to be analyzed and processed. In step 804, the processor generates a time-frequency representation of the audio data to be applied as input for a transformer-based neural network model. The transformer-based neural network model includes a transformer-in-transformer module, which includes a spectral transformer and a temporal transformer as disclosed herein. In step 806, the processor determines spectral embeddings and first temporal embeddings of the audio data based on the time-frequency representation of the audio data. The spectral embeddings include a first frequency class token (FCT).

In step 808, the processor determines each vector of a second FCT by passing each vector of the first FCT in the spectral embeddings through the spectral transformer. In step 810, the processor determines second temporal embeddings by adding a linear projection of the second FCT to the first temporal embeddings. In step 812, the processor determines third temporal embeddings by passing the second temporal embeddings through the temporal transformer. In step 814, the processor generates music information of the audio data based on the third temporal embeddings.

The method 800, in some example, may pertain to the dataflow within a single spectral TNT block, and it should be understood that the TNT-based neural network model may have multiple such TNT blocks that are functionally coupled or stacked together, for example serially such that the output from the first TNT block is used as an input for the subsequent TNT block, in order to improve the efficiency and efficacy of training the model based on the training data set in the database.

In some examples, each of the spectral transformer and the temporal transformer includes a plurality of encoder layers, each encoder layer including a multi-head self-attention module, a feed-forward network module, and a layer normalization module. Each of the spectral transformer and the temporal transformer may include a plurality of decoder layers configured to receive an output matrix from one of the encoder layers, each decoder layer including a multi-head self-attention module, a feed-forward network module, a layer normalization module, and an encoder-decoder attention module.

Additional steps may be implemented in the method 800 as disclosed herein. For example, the processor may determine the dimensions of the spectral embedding matrices based on a number of frequency bins and a number of channels employed by the multilevel transformer, and further determine a number of the spectral embedding matrices based on a number of time-steps employed by the multilevel transformer. For example, the processor may determine a vector length of the temporal embedding vectors based on a number of features employed by the multilevel transformer, and further determine a number of the temporal embedding vectors based on a number of time-steps employed by the multilevel transformer. The spectral transformer and the temporal transformer may be arranged hierarchically such that the spectral (lower-level) transformer learns the local information of the audio data and the temporal (higher-level) transformer learns the global information of the audio data.

In some examples, a positional encoding block is operatively coupled with the multilevel transformer such that a concatenator of the positional encoding block concatenates the FCT vectors with a convoluted time-frequency representation of the audio data, and an element-wise adder of the positional encoding block adds the FPE matrices to the convoluted time-frequency representation of the audio data.

There are numerous advantages in implementing such method or processing device to train a transformer-based neural network model via the use of the multilevel transformer. For example, the multilevel transformer is capable of learning the representation for audio data such as music or vocal signals and demonstrating improved performance in music tagging, vocal melody extraction, and chord recognition. In some examples, the multilevel transformer is capable of learning a more effective model using smaller datasets due to the multilevel transformer being configured such that only the important local information is passed to the temporal transformer through FCTs, which largely reduces the dimensionality of the data flow compared to the other transformer-based models for learning audio data, as known in the art. The reduction in data flow dimensionality facilitates more efficient machine learning due to reduced workload.

Although features and elements are described above in particular combinations, each feature or element can be used alone without the other features and elements or in various combinations with or without other features and elements. The methods provided may be implemented in a general purpose computer, a processor, or a processor core. Suitable processors include, by way of example, a general purpose processor, a special purpose processor, a conventional processor, a digital signal processor (DSP), a plurality of microprocessors, one or more microprocessors in association with a DSP core, a controller, a microcontroller, Application Specific Integrated Circuits (ASICs), Field Programmable Gate Arrays (FPGAs) circuits, any other type of integrated circuit (IC), and/or a state machine. Such processors may be manufactured by configuring a manufacturing process using the results of processed hardware description language (HDL) instructions and other intermediary data including netlists (such instructions capable of being stored on a computer readable media). The results of such processing may be mask works that are then used in a semiconductor manufacturing process to manufacture a processor which implements aspects of the examples.

The methods or flow charts provided herein may be implemented in a computer program, software, or firmware incorporated in a non-transitory computer-readable storage medium for execution by a general purpose computer or a processor. Examples of non-transitory computer-readable storage mediums include a read only memory (ROM), a random access memory (RAM), a register, cache memory, semiconductor memory devices, magnetic media such as internal hard disks and removable disks, magneto-optical media, and optical media such as CD-ROM disks, and digital versatile disks (DVDs).

In the preceding detailed description of the various examples, reference has been made to the accompanying drawings which form a part thereof, and in which is shown by way of illustration specific preferred examples in which the invention may be practiced. These examples are described in sufficient detail to enable those skilled in the art to practice the invention, and it is to be understood that other examples may be utilized, and that logical, mechanical and electrical changes may be made without departing from the scope of the invention. To avoid detail not necessary to enable those skilled in the art to practice the invention, the description may omit certain information known to those skilled in the art. Furthermore, many other varied examples that incorporate the teachings of the disclosure may be easily constructed by those skilled in the art. Accordingly, the present invention is not intended to be limited to the specific form set forth herein, but on the contrary, it is intended to cover such alternatives, modifications, and equivalents, as can be reasonably included within the scope of the invention. The preceding detailed description is, therefore, not to be taken in a limiting sense, and the scope of the present invention is defined only by the appended claims. The above detailed description of the embodiments and the examples described therein have been presented for the purposes of illustration and description only and not by limitation. For example, the operations described are done in any suitable order or manner. It is therefore contemplated that the present invention covers any and all modifications, variations or equivalents that fall within the scope of the basic underlying principles disclosed above and claimed herein.

The above detailed description and the examples described therein have been presented for the purposes of illustration and description only and not for limitation.

What is claimed is:

1. An apparatus comprising:

at least one processor and a non-transitory computer-readable medium storing therein computer program code including instructions for one or more programs that, when executed by the processor, cause the processor to:

obtain audio data;

generate a time-frequency representation of the audio data to be applied as input for a transformer-based neural network model, the transformer-based neural network model including a spectral transformer and a temporal transformer;

determine spectral embeddings and first temporal embeddings of the audio data based on the time-frequency representation of the audio data, the spectral embeddings including a first frequency class token (FCT);

determine each vector of a second FCT by passing each vector of the first FCT in the spectral embeddings through the spectral transformer;

determine second temporal embeddings by adding a linear projection of the second FCT to the first temporal embeddings;

determine third temporal embeddings by passing the second temporal embeddings through the temporal transformer; and generate music information of the audio data based on the third temporal embeddings.

2. The apparatus of claim 1, wherein the spectral embeddings are determined by generating the first FCT to include at least one spectral feature from a frequency bin and frequency positional encodings (FPE) to include at least one frequency position of the first FCT.

3. The apparatus of claim 1, wherein each of the spectral transformer and the temporal transformer comprises a plurality of encoder layers.

4. The apparatus of claim 3, wherein each of the spectral transformer and the temporal transformer comprises a plurality of decoder layers configured to receive an output from one of the encoder layers.

5. The apparatus of claim 1, wherein the spectral embeddings are matrices with matrix dimensions that are determined based on a number of frequency bins and a number of channels employed by the spectral transformer, and a number of the spectral embeddings is determined by a number of time-steps employed by the spectral transformer.

6. The apparatus of claim 1, wherein the temporal embeddings are vectors having a vector length determined by a number of features employed by the temporal transformer, and a number of the temporal embeddings is determined by a number of time-steps employed by the temporal transformer.

7. The apparatus of claim 1, wherein the transformer-based neural network model comprises a plurality of spectral transformers and temporal transformers in a stacked configuration such that the temporal embedding is updated through each of the plurality of temporal transformers.

8. The apparatus of claim 1, wherein the spectral transformer and the temporal transformer are arranged hierarchically such that the spectral transformer is configured to generate local music information of the audio data and the temporal transformer is configured to generate global music information of the audio data.

9. A method implemented by at least one processor comprising:

obtaining audio data;

generating a time-frequency representation of the audio data to be applied as input for a transformer-based neural network model, the transformer-based neural network model including a spectral transformer and a temporal transformer;

determining spectral embeddings and first temporal embeddings of the audio data based on the time-frequency representation of the audio data, the spectral embeddings including a first frequency class token (FCT);

determining each vector of a second FCT by passing each vector of the first FCT in the spectral embeddings through the spectral transformer;

determining second temporal embeddings by adding a linear projection of the second FCT to the first temporal embeddings;

determining third temporal embeddings by passing the second temporal embeddings through the temporal transformer; and generating music information of the audio data based on the third temporal embeddings.

10. The method of claim 9, further comprising determining the spectral embeddings by generating the first FCT to include at least one spectral feature from a frequency bin and generating frequency positional encodings (FPE) to include at least one frequency position of the first FCT.

11. The method of claim 9, wherein each of the spectral transformer and the temporal transformer comprises a plurality of encoder layers.

12. The method of claim 11, wherein each of the spectral transformer and the temporal transformer comprises a plurality of decoder layers configured to receive an output from one of the encoder layers.

13. The method of claim 9, wherein the spectral embeddings are matrices with matrix dimensions that are determined based on a number of frequency bins and a number of channels employed by the spectral transformer, and a number of the spectral embeddings is determined by a number of time-steps employed by the spectral transformer.

14. The method of claim 9, wherein the temporal embeddings are vectors having a vector length determined by a number of features employed by the temporal transformer, and a number of the temporal embeddings is determined by a number of time-steps employed by the temporal transformer.

15. The method of claim 9, wherein the transformer-based neural network model comprises a plurality of spectral transformers and temporal transformers in a stacked configuration such that the temporal embedding is updated through each of the plurality of temporal transformers.

16. The method of claim 9, wherein the spectral transformer and the temporal transformer are arranged hierarchically such that the spectral transformer is configured to generate local music information of the audio data and the temporal transformer is configured to generate global music information of the audio data.

* * * * *